US009784441B2

(12) United States Patent
Pearson et al.

(10) Patent No.: US 9,784,441 B2
(45) Date of Patent: Oct. 10, 2017

(54) COMPACT A.C. POWERED LED LIGHT FIXTURE

(71) Applicants: Dennis Pearson, Foothall Ranch, CA (US); Michael D. Bremser, Seal Beach, CA (US); Dennis Barton, Costa Mesa, CA (US); James Johnson, Lake Forest, CA (US); Thomas Lueken, Beaumont, CA (US); Heng Chov, Huntington Beach, CA (US)

(72) Inventors: Dennis Pearson, Foothall Ranch, CA (US); Michael D. Bremser, Seal Beach, CA (US); Dennis Barton, Costa Mesa, CA (US); James Johnson, Lake Forest, CA (US); Thomas Lueken, Beaumont, CA (US); Heng Chov, Huntington Beach, CA (US)

(73) Assignee: Tempo Industries, LLC, Irvine, CA (US)

( * ) Notice: Subject to any disclaimer, the term of this patent is extended or adjusted under 35 U.S.C. 154(b) by 13 days.

(21) Appl. No.: 14/941,476

(22) Filed: Nov. 13, 2015

(65) Prior Publication Data

US 2017/0138578 A1 May 18, 2017

(51) Int. Cl.
*F21V 23/00* (2015.01)
*F21V 23/06* (2006.01)
(Continued)

(52) U.S. Cl.
CPC ..... *F21V 23/002* (2013.01); *F21V 23/005* (2013.01); *F21V 23/06* (2013.01); *F21Y 2101/02* (2013.01); *F21Y 2103/003* (2013.01)

(58) Field of Classification Search
None
See application file for complete search history.

(56) References Cited

U.S. PATENT DOCUMENTS 3,030,670 A 4/1962 Bigelow
5,620,369 A 4/1997 Spransy et al.
(Continued)

FOREIGN PATENT DOCUMENTS

DE 102009016753 A1 10/2010
DE 102010001777 A1 8/2011
(Continued)

OTHER PUBLICATIONS

EPO 15159756.4 extended European search report, dated Apr. 12, 2015.

(Continued)

*Primary Examiner* — Ashok Patel
(74) *Attorney, Agent, or Firm* — Lapple Ubell IP Law, LLP; Franklin D. Ubell

(57) ABSTRACT

A compact LED light fixture includes an LED circuit board whose top surface mounts one or more LED's and an A.C. LED Driver circuit. An input circuit board is mounted on an underside of the mounting platform. Unconditioned A.C. power from electrical cables positioned in a wire way is conducted by an electrical connector to the top surface the LED circuit board, then across and down through the top surface of the LED circuit board to the input circuit board where the A.C. power is conditioned and then conducted back through the LED circuit board to the A.C. LED driver.

20 Claims, 8 Drawing Sheets

(51) Int. Cl.
*F21Y 101/02* (2006.01)
*F21Y 103/00* (2016.01)

(56) References Cited

U.S. PATENT DOCUMENTS

| | | | | |
|---|---|---|---|---|
| 6,351,920 | B1 | 3/2002 | Hopkins et al. | |
| 7,726,840 | B2 | 6/2010 | Pearson et al. | |
| 8,002,426 | B2 | 8/2011 | Pearson et al. | |
| 8,061,870 | B2 | 11/2011 | Pearson et al. | |
| 8,398,276 | B2 | 3/2013 | Pearson et al. | |
| 8,864,347 | B2 * | 10/2014 | Pearson | F21S 2/005 362/362 |
| 9,217,247 | B2 | 12/2015 | Behling et al. | |
| 9,322,533 | B1 * | 4/2016 | Pearson | F21V 21/02 |
| 2006/0238136 | A1 | 10/2006 | Johnson III et al. | |
| 2009/0225546 | A1 * | 9/2009 | Pearson | F21S 2/005 362/249.06 |
| 2010/0259931 | A1 | 10/2010 | Chemel et al. | |
| 2011/0188233 | A1 * | 8/2011 | Josefowicz | F21S 8/086 362/158 |
| 2012/0051041 | A1 | 3/2012 | Edmond et al. | |
| 2012/0063138 | A1 | 3/2012 | Leadford et al. | |
| 2012/0091903 | A1 | 4/2012 | Bembridge et al. | |
| 2013/0021792 | A1 | 1/2013 | Snell et al. | |
| 2013/0070461 | A1 | 3/2013 | Pickard | |
| 2013/0169160 | A1 | 7/2013 | Kim et al. | |
| 2013/0176722 | A1 | 7/2013 | Lay et al. | |
| 2013/0208457 | A1 | 8/2013 | Durkee et al. | |
| 2013/0208469 | A1 | 8/2013 | Progl | |
| 2013/0250567 | A1 | 9/2013 | Edmond et al. | |
| 2013/0271979 | A1 | 10/2013 | Pearson et al. | |
| 2013/0272000 | A1 | 10/2013 | Pearson et al. | |
| 2013/0279165 | A1 | 10/2013 | Pearson et al. | |
| 2013/0279179 | A1 | 10/2013 | Pearson et al. | |
| 2013/0279180 | A1 | 10/2013 | Pearson et al. | |
| 2015/0084943 | A1 | 3/2015 | Kim et al. | |
| 2015/0267910 | A1 * | 9/2015 | Lazalier | F21V 7/0066 362/267 |
| 2015/0345768 | A1 * | 12/2015 | Lee | F21V 29/70 362/218 |

FOREIGN PATENT DOCUMENTS

| | | | |
|---|---|---|---|
| WO | 2011139764 | A2 | 11/2011 |
| WO | 2012129243 | A1 | 9/2012 |

OTHER PUBLICATIONS

"AC-LED lighting products find niche, perhaps more," LEDs Magazine, Jul./Aug. 2012.

* cited by examiner

COMPACT A.C. POWERED LED LIGHT FIXTURE

FIELD

The subject disclosure relates to LED electric lighting fixtures, and more particularly to compact A.C. powered LED electric lighting fixtures.

DESCRIPTION OF RELATED ART

Various LED electric light fixtures have been constructed in the past, for example, such as those disclosed in U.S. Pat. Nos. 7,726,840 and 8,864,347, both assigned to Tempo Industries, LLC.

SUMMARY

According to an illustrative embodiment, a compact LED light fixture comprises a wireway having first and second sides and a bottom surface defining a longitudinally extending channel for receiving at least first and second electrical cables. A longitudinally extending circuit board mounting platform is mounted to the wireway. The circuit board mounting platform carries an LED circuit board carrying one or more LEDs and an A.C. LED Driver circuit. An input circuit board is located in the wireway beneath the circuit board mounting platform and includes circuitry configured to receive an unconditioned A.C. line signal and to supply a conditioned A.C. line signal to the A.C. LED driver circuitry on the first circuit board. In an illustrative embodiment, an electrical connector transfers unconditioned A.C. power from the first and second electrical cables in the wireway to first and second electrically conductive power pins which extend through the LED circuit board. The unconditioned A.C. power is then conducted across the LED circuit board by electrical conductor traces formed thereon and then down through the LED circuit board to input terminals of the input circuit board.

The illustrative embodiments result in a light fixture having a much lower profile than other constructions, e.g. ¾" high instead of 1½" high. Additionally, the location of the input circuit board may be changed, for example, to allow for mounting optics and to also facilitate ease of replacement of the board.

DETAILED DESCRIPTION OF THE PREFERRED EMBODIMENTS

Figure 1:
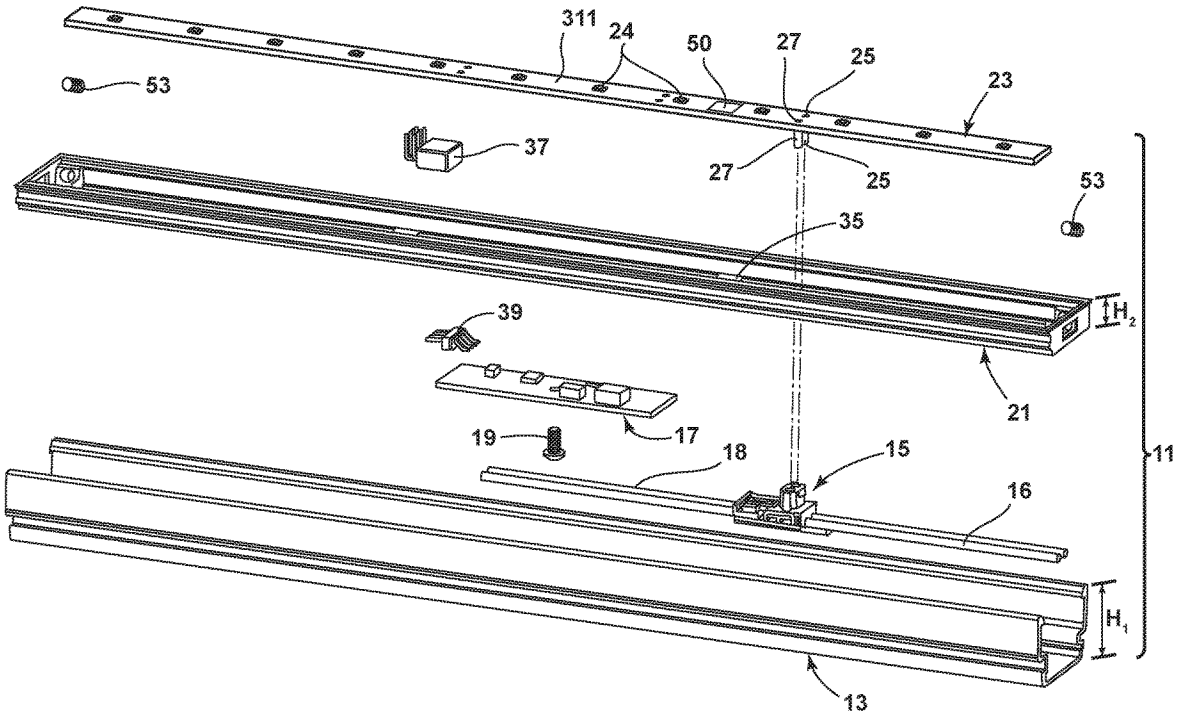
FIG. 1 is an exploded perspective view of a compact A.C. powered LED light fixture according to an illustrative embodiment.

An illustrative embodiment of a compact A.C. powered LED light fixture 11 is illustrated in FIG. 1. The fixture 11 includes a wireway 13, an electrical connector 15, electrical cables or leads 16, 18, an input circuit board 17, an LED circuit board mounting platform 21, and an LED circuit board 23. In one embodiment, the wireway 13 may be an aluminum extrusion, while the mounting platform 21 may be a metal casting formed of, for example 380 alloy aluminum. In one embodiment, a screw 19 attaches the input circuit board 17 to the underside of the LED mounting platform 21. In one embodiment, heights H1 and H2 may be 0.33 and 0.80 inches, respectively.

The LED circuit board 23 mounts one or more LEDs or LED modules, e.g. 24 on a top surface 31 thereof, and has a pair of power pins 25, 27, which depend from an undersurface of the circuit board 23, and which further pass through the board 23 and appear on its top surface 311. The pair of pins 25, 27 is positioned to pass through a hole or aperture 35 in the circuit board mounting platform 21 and to electrically connect with the electrical connector 15 and with a pair of conductor traces on the LED carrying circuit board 23, as described in further detail hereafter. In various embodiments, a suitable lens component or components may be configured to cover the LEDs 24.

Figure 2:
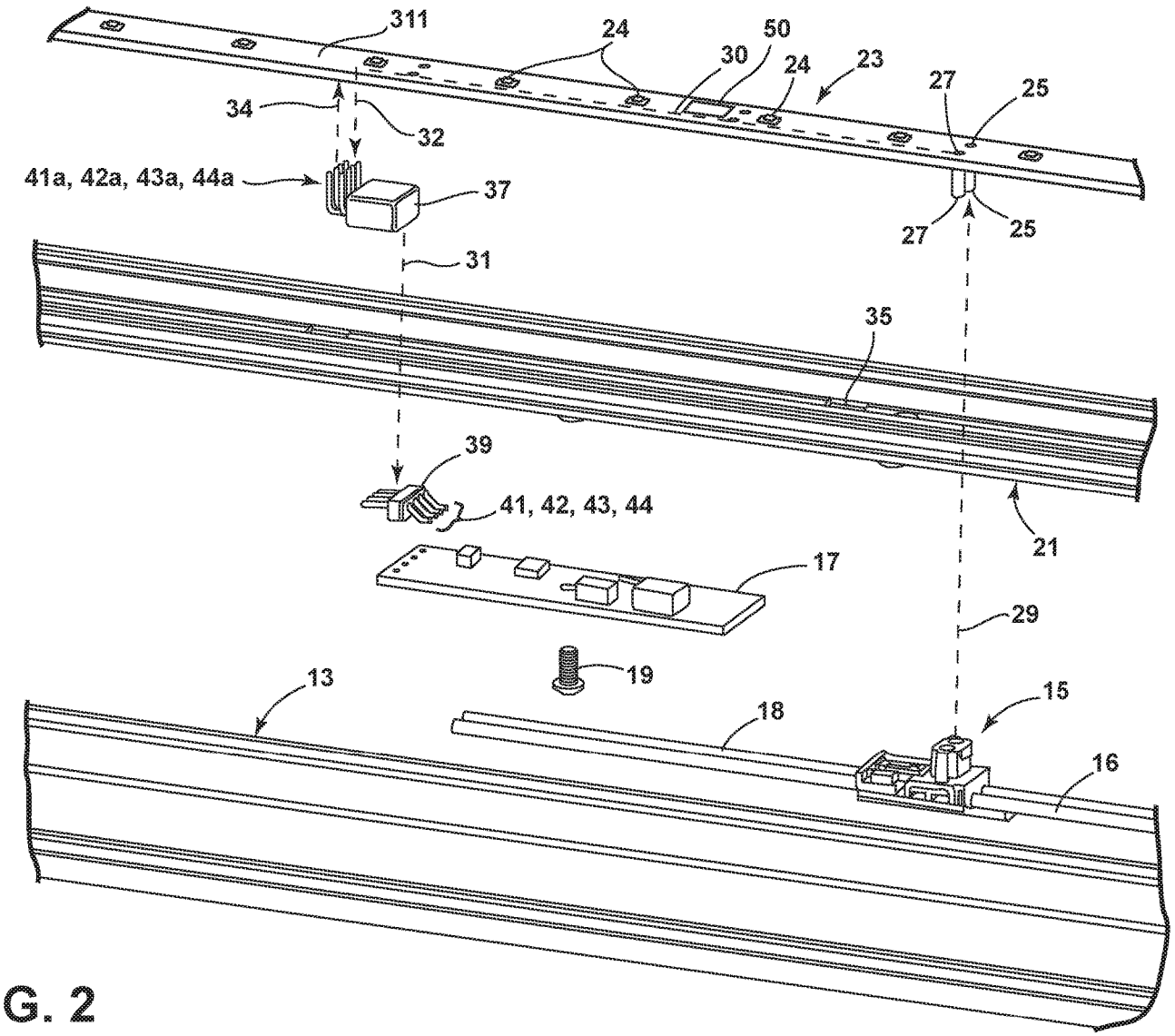
FIG. 2 is a fragmentary exploded perspective view of a compact A.C. powered LED light fixture according to an illustrative embodiment.

As seen in FIG. 2, the input circuit board 17 carries circuitry which receives A.C. power, e.g. 120 volts A.C., at input terminals 41, 42 and provides conditioned power at output terminals 43, 44 to A.C. LED Driver circuitry 50 located on the LED circuit board 23 in order to illuminate the LEDs 24.

Power flow in an illustrative embodiment is illustrated schematically in FIG. 2. Unconditioned A.C. input power (e.g. a line voltage of 120 volts A.C.) is transferred by the electrical connector 15 from cables or leads 16, 18 to the electrical pins 25, 27, as indicated schematically by a first vertical dashed line 29. This unconditioned A.C. power is then conducted across the LED circuit board 23 by a pair of electrical conductor traces illustrated schematically by a horizontal dashed line 30 on the top surface 311 of the circuit board 23 to an electrical connector 37. In one embodiment, pins 41*a*, 42*a*, 43*a*, and 44*a* of the electrical connector 37 are soldered to the LED circuit board 23, thereby attaching the connector 37 to the circuit board 23. Power is conducted from the LED circuit board 23 via pins 41*a*, 42*a*, to a mating connector 39 mounted on the input circuit board 17, as illustrated by a second vertical dashed line 31. As mentioned above and described in further detail below, the input circuit board 17 conditions the unconditioned A.C. power and supplies a conditioned A.C. power signal to the A.C. LED Driver circuitry 50 through the combination of connectors 37 and 39 and pins 43*a*, 44*a*, as indicated by a third vertical dashed line 34.

Figure 4:
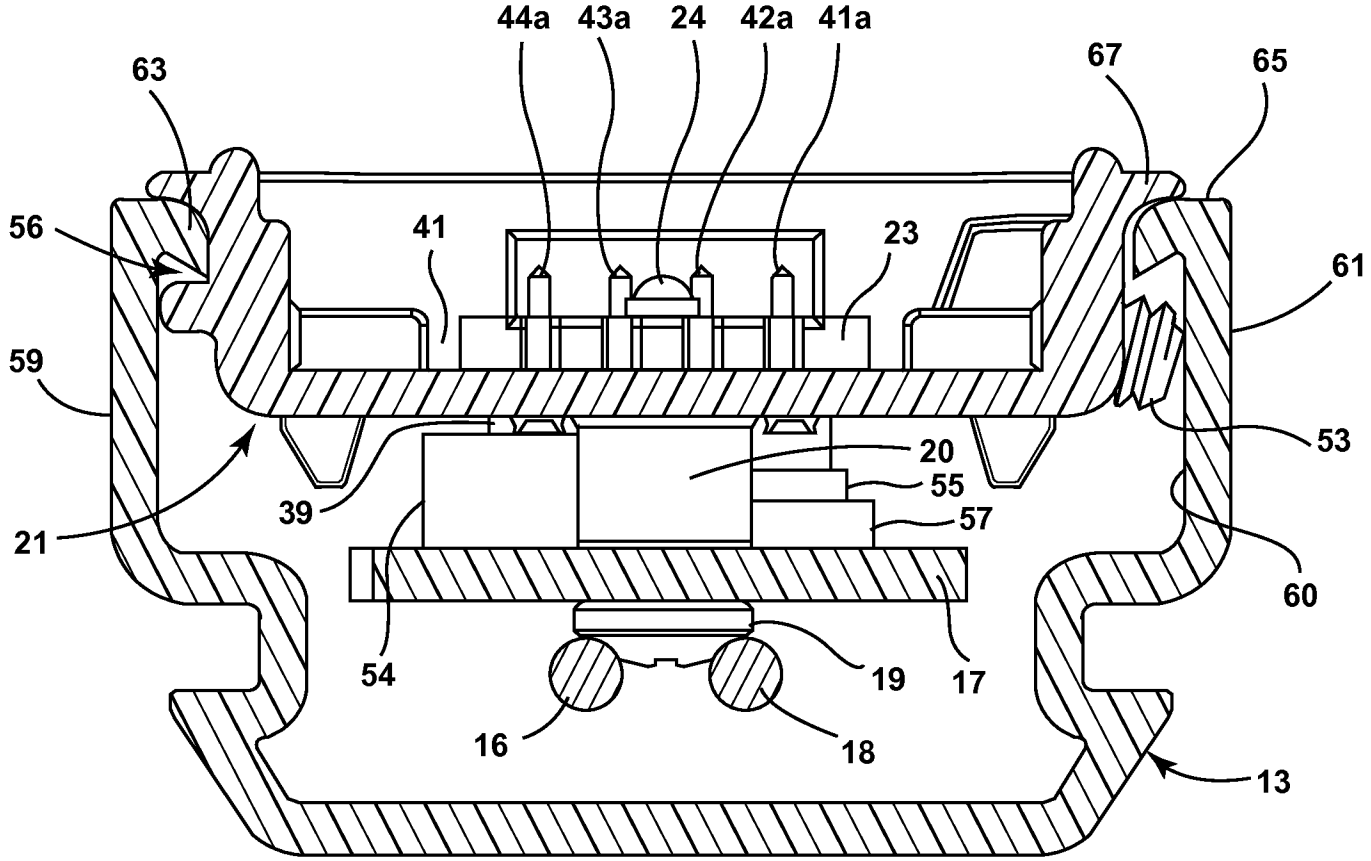
FIG. 4 is a cross-sectional view taken at IV-IV of FIG. 3.

FIG. 4 illustrates how the circuit board mounting platform 21 and the wire way 13 mate and attach together according to an illustrative embodiment. As illustrated in FIG. 4, the wireway 13 has respective vertical side surfaces 59, 61, which turn inwardly at their upper ends to respectively form a pivot point 63 and a horizontal support surface 65. The left side of the circuit board mounting platform 21 has a groove 56 formed therein at pivot point 63 to facilitate attachment of the mounting platform 21 to the wire way 13. A horizontally extending surface 67 is formed at the right side of the mounting platform 21 and rests on the support surface 65. In one embodiment, the groove 56 on the left edge of the mounting platform 21 is mated at an angle with the pivot point 63 and then rotated downwardly to establish an interlocking relationship or engagement between the mounting platform 21 and the wireway 13. At this point, the respective mounting screws 53 are inserted at opposite ends of the mounting platform 21 and bite into the inner side of the wireway 13 to firmly hold the assembly together.

FIG. 4 further illustrates electronic components 54, 55, 57 mounted to the input circuit board 17 and an internally threaded boss 20, which is formed on the underside of the mounting platform 21 and into which the mounting screw 19 is threaded. In one embodiment, the circuit board mounting platform 21 has a generally rectangular depression or channel 41 shaped to receive the LED circuit board 23.

Figure 5:
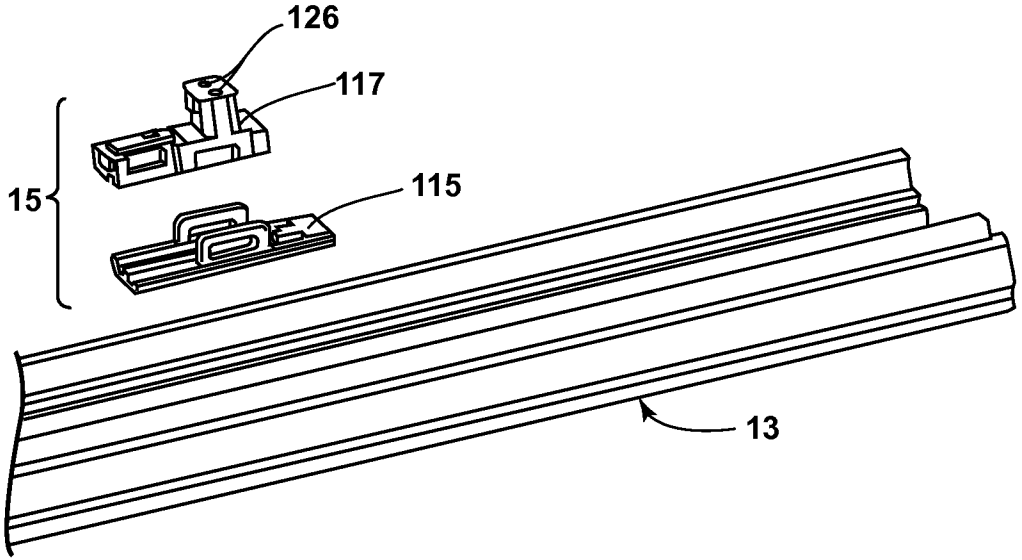
FIG. 5 is a fragmentary perspective view illustrating electrical connector apparatus according to an illustrative embodiment.
Figure 6:
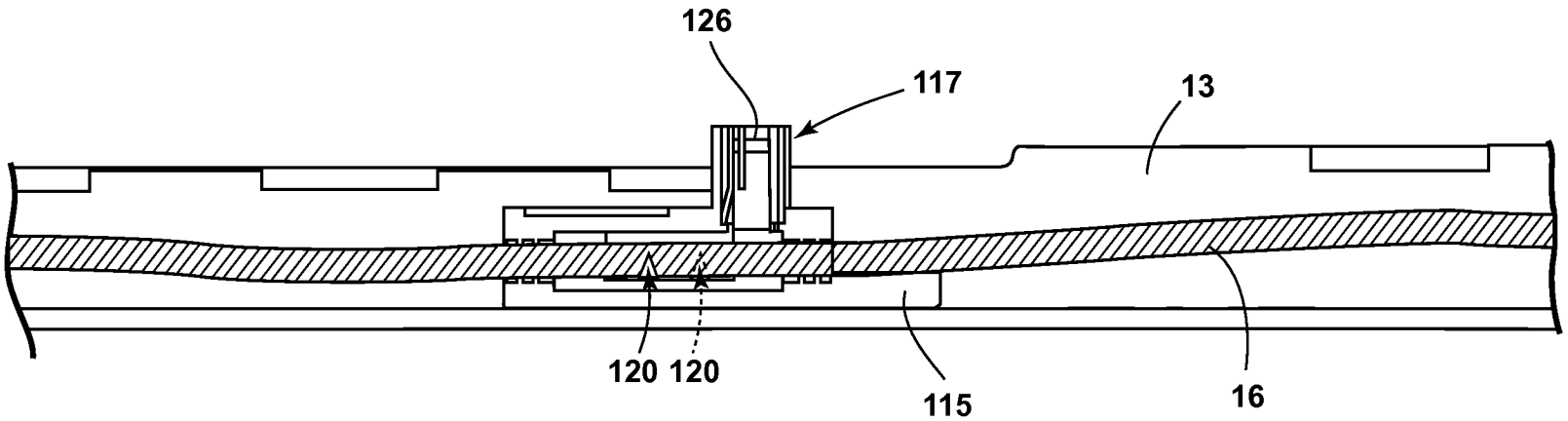
FIG. 6 is a cross-sectional view further illustrating the electrical connector apparatus of FIG. 5.

FIGS. 5 and 6 further illustrate one embodiment of the electrical connector 15, which includes a bottom receptacle holder 115, and a snap-in female receptacle holder 117. The bottom receptacle holder 115 works in cooperation with the snap-in female receptacle holder 117 to insert and hold two female electrically conductive insulation piercing pins 120 that respectively pierce electrical cables 16, 18. The two connector components contain a mating internal conductor structure having a pair of openings 126 which electrically connect with respective mating pins 25, 27.

In assembly of the fixture, the pins 25, 27 shown in FIG. 2 are soldered or otherwise attached to the LED circuit board 23, which is then attached to the circuit board mounting platform 21 by heat transmissive double-sided tape or other attachment mechanism such that the pins 25, 27 protrude from the bottom of the mounting platform. The pins 41*a*, 42*a*, 43*a*, 44*a* of the connector 37 are then inserted through the mounting platform 21 and through suitable openings in the circuit board 23 and soldered to the circuit board 23. The connector 39 is soldered in place on the input circuit board 17 and mated with the connector 37, whereafter the input circuit board is attached to the outside bottom surface of the mounting platform 21 by the mounting screw 19. The connector 15 may thereafter be mated with the pins 25, 27, and the wire way 13 may then be attached to the mounting platform 21 using screws 53 as described above.

Figure 3:
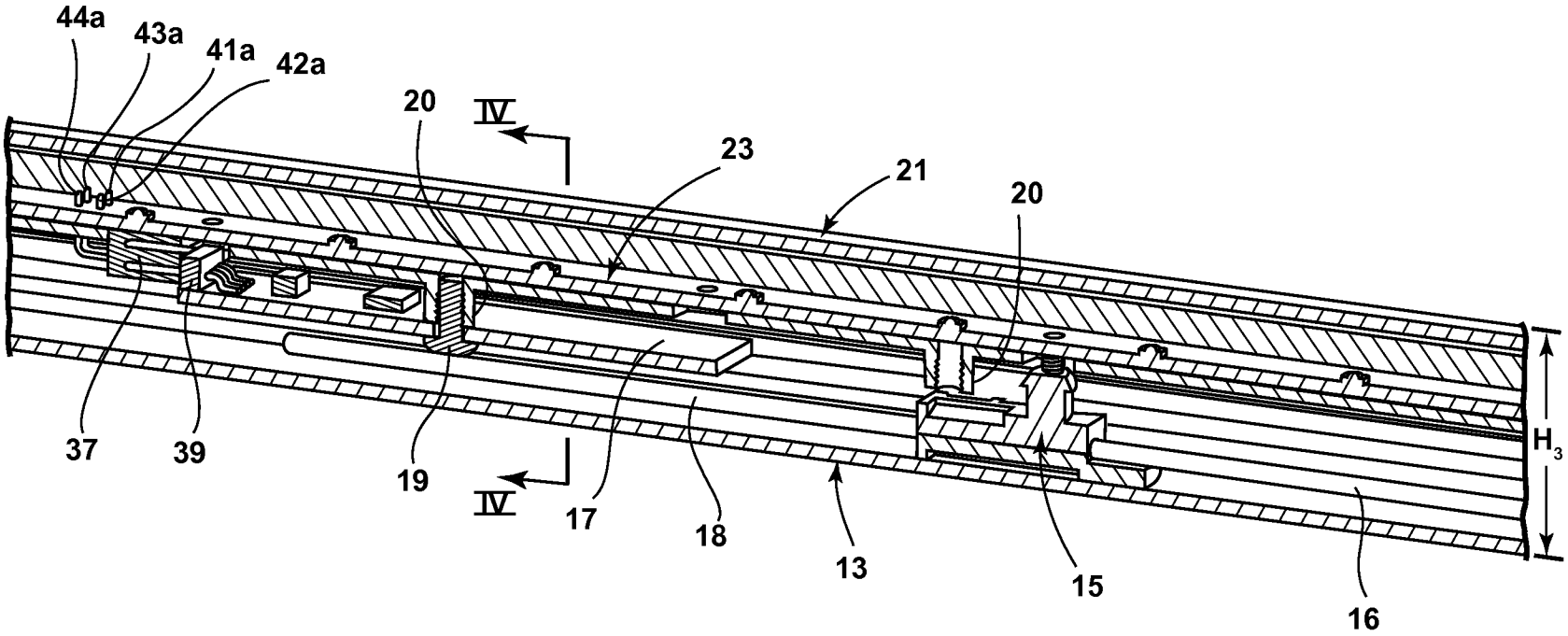
FIG. 3 is a fragmentary longitudinal cross-sectional perspective view of an assembled compact A.C. powered LED light fixture according to an illustrative embodiment.

The illustrative embodiments result in a light fixture having a much lower profile than other constructions, e.g. having an overall height H3 of ¾" high (FIG. 3), instead of, for example, 1½" high. Additionally, the location of the input circuit board 17 may be changed, for example, to allow for mounting optics and to also allow ease of replacement of the circuit board 17. In illustrative embodiments, the reduced profile is achieved in part by the longitudinal separation of connection functions by allocation of selected connector functions to connectors 15 and pins 25 27 and to connectors 37, 39 along with the layout of conductor paths to facilitate that separation.

Figure 7:
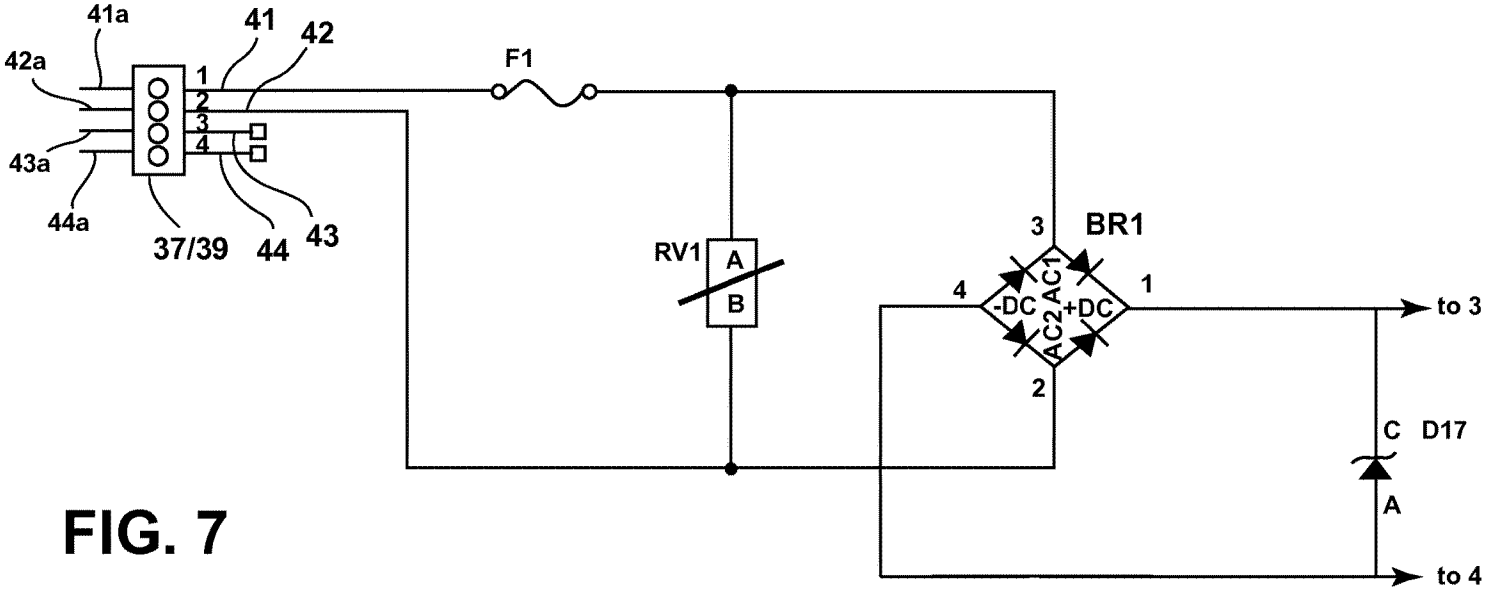
FIG. 7 is an electrical circuit diagram of input circuitry according to an illustrative embodiment.

An illustrative embodiment of the input circuitry mounted on the input circuit board 17 is shown in FIG. 7. As shown, the unconditioned A.C. input on input lines 41, 42 is connected to pins 2 and 3 of a diode bridge BR1. The input circuitry further includes a bidirectional Transorb Diode (TVS) D17 connected across pins 1 and 4 and a MOV (metal oxide varistor), RV1, connected across pins 2 and 3 of the diode bridge BR1. A fuse F1 is also provided in one of the input signal lines.

With respect to operation of the circuit of FIG. [4] 7, the A.C. LED driver 51 (FIG. 9) requires protection against external high voltage spikes and current surges. The input current is limited by the fuse F1, which in one embodiment may be rated for 1 Amp at 250 VAC. Right after the fuse F1, any transient voltage spikes are clamped by the MOV, RV1.

Figure 8:
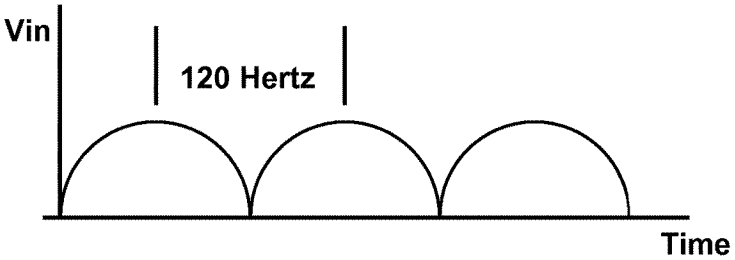
FIG. 8 is a wave form diagram illustrating an output wave form of the circuit circuitry of FIG. 7.

The input A.C. voltage is rectified by the Diode Bridge, BR1 to 120 Hertz from 60 Hertz. In one illustrative embodiment, the peak voltages are clipped/reduced by the Diode Bridge BR1 to about 86 Vpeak from 115 Vpeak. In such an embodiment, the input voltages can fluctuate between 110 to 120 Vrms. An illustrative rectified input voltage Vin is illustrated in FIG. 8.

The bidirectional Transorb Diode (TVS) D17 provides a secondary voltage clamp in case some voltage spikes get through the MOV, RV1. Once the input voltage passes the input circuit, the voltage across terminals 101, 103 (FIG. 9) is about 100 VDC, 72 mA, 7.20 Watts in one embodiment.

Figure 9:
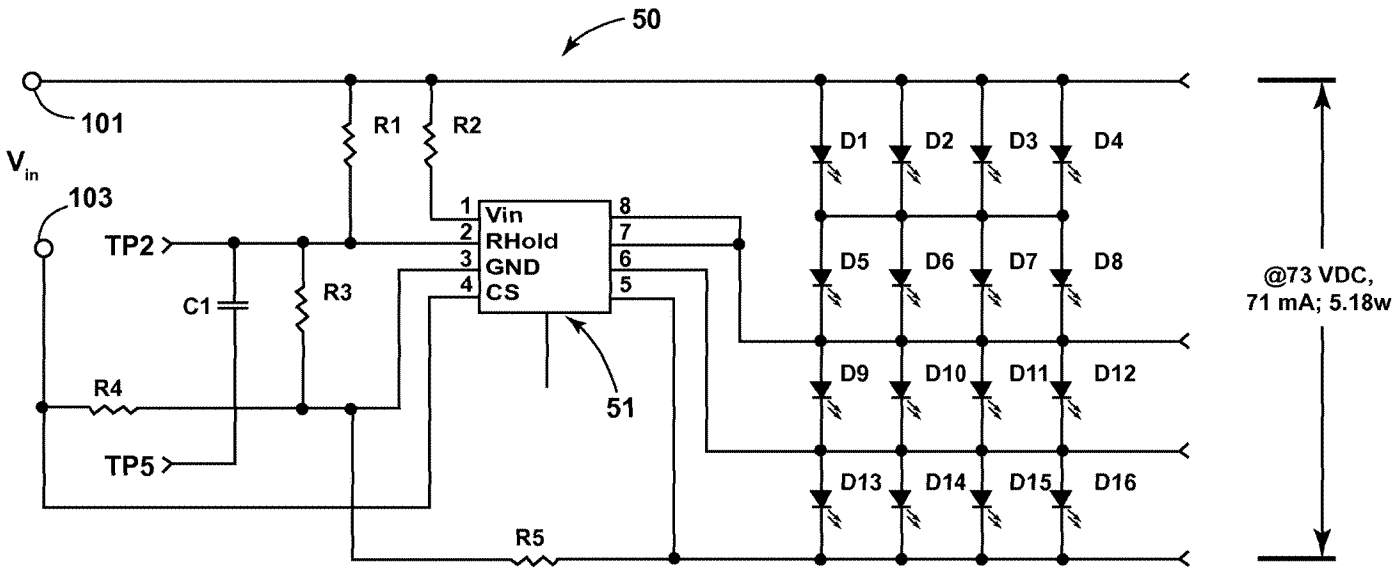
FIG. 9 is an electrical circuit diagram of A.C. LED driver circuitry according to an illustrative embodiment.

FIG. 9 shows illustrative circuitry 50 located on the LED circuit board 23 for controlling the light output of a number of LEDs designated D1, D2, D3 . . . D16. In the circuit of FIG. 9, the positive input voltage Vin is supplied to a first terminal of resistors R1, R2, and to the anodes of LEDs D1, D2, D3, D4. The negative input at terminal 103 is connected to an input CS of the A.C. LED Driver 51 and through a first terminal of a resistor R4 to a ground terminal GND of the A.C. LED Driver 51. The second terminal of the resistor R3 is also connected to a second terminal of the resistor R1 and to an RHOLD terminal of the Driver 51. Respective terminals TP2, TP5, have a capacitor C1 connected thereacross and connected to RHOLD and GND, respectively. In one embodiment, the A.C. LED Driver 51 may be a Magna Chip part no. MAP9002 available from MagnaChip Semiconductor Ltd., 891, Daechi-Dong, Kangnam-Gu, Seoul, 135-738 Korea.

Figure 10:
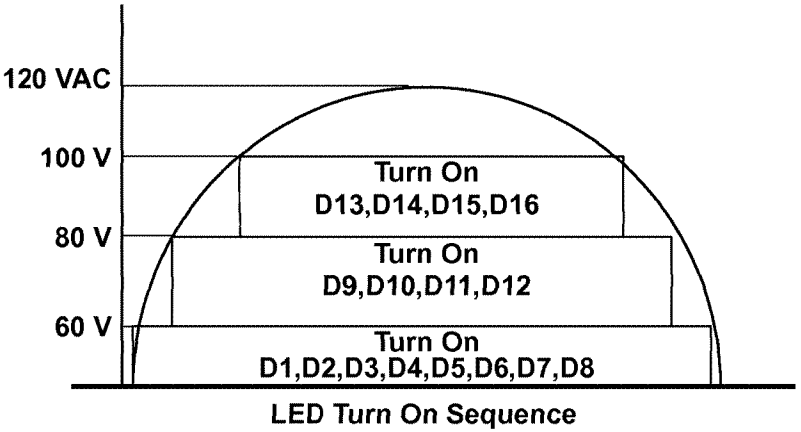
FIG. 10 is a schematic wave form diagram illustrative of operation of the circuit of FIG. 9.

The circuitry of FIG. 9 functions as follows: the AC driver 51 from MagnaChip is based on the principle of driving LEDs by turning on different groups or stages of LEDs using a stepping up and stepping down voltage from zero to 120 VAC or 220 VAC, as illustrated in FIG. 10. For illustrative 120 Vrms systems, the number of LEDs depends on the stack up of the LED's forward voltages. In one embodiment, it is desirable that the stacked forward voltages come as close to the 120 Vpeak as possible. In one embodiment of the illustrative circuit of FIG. 9, Nichia 24 Volt LEDs are used in series and parallel. FIG. 9 illustrates four LEDs in series (D1, D5, D9 & D13) and LEDs connected in parallel with each of those LEDs D1, D5, D9, D13. The LEDs in parallel are used to control the currents flowing through each LED. As the numbers of LEDs are added or removed in parallel, the amount of current distributed into the LED is reduced or increased proportionally. Hence, the light output for the LEDs in each stage can be adjusted.

In the illustrative circuit of FIG. 9, there are three stages. The first stage of LEDs (D1, D2, D3, D4, D5, D6, D7, & D8) turns on first. Potential flickering of the light output for this stage can be controlled by using a dimmer with low end trimming. For example, a Lutron MAELV-600P can be used to cause the LEDs to stay on when power is initially applied. The second stage to turn on is D9, D10, D11, and D12. LEDs D13, D14, D15, D16 are in the last stage to turn on. Once turned on, each stage remains on until the voltage level falls below the turn-on voltage for the particular stage. As illustrated in FIG. 10, the corresponding peak voltages for each stage in the illustrative embodiment are respectively, 60, 80 and 100 volts.

In illustrative embodiments of the circuit of FIG. 9, the voltages across the LEDs are about 73 VDC (without using a dimmer) and 61 VDC with a dimmer, and the LEDs are operating at a total wattage of about 5.18 Watt. The power across the LEDs will be less when using a dimmer since all dimmers have some loss. In various embodiments, the LEDs will see different power levels depending on the dimmer.

The Map9002 driver 51 has the capability to monitor when the input signal reaches the zero crossing points and to compensate for the loss of signal to keep the LEDs from flickering or blinking. The zero crossings are detected by the RHOLD pin.

The MAP9002 driver 51 is recommended to operate at 8 Watts. In the illustrative circuit of FIG. 9, R4 is the power setting resistor, and at 13 Ohms, the power across the LEDs is about 5.18 Watt at 72% efficiency. The driver chip has a small metal plate on the bottom for heat sinking.

From the foregoing, those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. An LED light fixture comprising:

a wireway having first and second sides and a bottom surface defining a channel for receiving at least first and second electrical cables;

a circuit board mounting platform configured to be received and supported by said wireway;

a first circuit board carrying one or more LED's and an A.C. LED Driver circuit, the first circuit board being mounted on said circuit board mounting platform;

an input circuit board located in said wireway beneath said first circuit board, the input circuit board comprising circuitry configured to receive an unconditioned A.C. line signal and convert the unconditioned A. C. line signal to a conditioned A.C. line signal suitable for supply to said A.C. LED driver circuit;

a first electrical connector configured to conduct unconditioned A.C. power from said first and second cables to first and second electrically conductive power pins positioned to supply power to a top surface of said first circuit board; and a first electrical conductor path for conducting said unconditioned A.C. power across said first circuit board and down and through said first circuit board to said input circuit board.

2. The LED light fixture of claim 1 further comprising a second electrical conductor path for conducting the conditioned A.C. line signal from said input circuit board to said A.C. LED Driver circuit.

3. The LED light fixture of claim 2 wherein said input circuit board is attached to a bottom surface of said circuit board mounting platform.

4. The LED light fixture of claim 2 wherein said first electrical conductor path comprises:

a second electrical connector positioned beneath said first circuit board and having third and fourth electrically conductive power pins extending through said first circuit board and spaced apart from said first and second power pins;

first and second conductor traces formed on said first circuit board and respectively connected at one end to said first and second power pins and at an opposite end to said third and fourth power pins;

a third electrical connector configured to mate with said second electrical connector and to supply said unconditioned A.C. power to said input circuit board.

5. The LED light fixture of claim 4 wherein said second electrical conductor path comprises fifth and sixth electrically conductive power pins on said second electrical connector and wherein said third electrical connector is configured to receive said conditioned A.C. line signal from said input circuit board.

6. The LED light fixture of claim 2 wherein said second electrical conductor path comprises fifth and sixth electrically conductive power pins on said second electrical connector and wherein said third electrical connector is configured to receive said conditioned A.C. line signal from said input circuit board.

7. The LED light fixture of claim 1 wherein said first electrical conductor path comprises:

a second electrical connector positioned beneath said circuit board and having third and fourth electrically conductive power pins extending through said circuit board and spaced apart from said first and second power pins;

first and second conductor traces formed on said circuit board and respectively connected at one end to said first and second power pins and at and an opposite end to said third and fourth power pins;

a third electrical connector configured to mate with said second electrical connector and to supply said unconditioned A.C. power to said input circuit board.

8. The LED light fixture of claim 1 wherein said circuitry comprises a diode bridge.

9. The LED light fixture of claim 8 wherein said circuitry further comprises a transorb diode and a metal oxide varistor.

10. An LED light fixture comprising:

a first circuit board carrying one or more LEDs and an A.C. LED Driver circuit on a top surface thereof;

an input circuit board located beneath said first circuit board, the input circuit board comprising circuitry configured to receive an unconditioned A.C. line signal at an input thereof and to supply a conditioned A.C. line signal to said A.C. LED driver circuit; and a first A. C. conductor path running from a bottom surface of said first circuit board, up through said first circuit board and across the top surface of said first circuit board and down through said first circuit board to the input of said input circuit board.

11. The LED light fixture of claim 10 wherein said first A. C. conductor path is connected to a source of A.C. line voltage.

12. The LED light fixture of claim 10 wherein said circuitry comprises a diode bridge.

13. The LED light fixture of claim 12 wherein said circuitry further comprises a transorb diode and a metal oxide varistor.

14. The LED light fixture of claim 10 further comprising a first electrical connector configured to conduct unconditioned A.C. power from first and second cables to first and second electrically conductive power pins positioned to supply power to a top surface of said first circuit board.

15. The LED light fixture of claim 10 further comprising a second electrical conductor path for conducting the conditioned A.C. line signal from said input circuit board to said A.C. LED Driver circuit.

16. The LED light fixture of claim 15 wherein said circuitry comprises a diode bridge.

17. The LED light fixture of claim 16 wherein said circuitry further comprises a transorb diode and a metal oxide varistor.

18. The LED light fixture of claim 10 wherein said first A.C. conductor path comprises:

a second electrical connector positioned beneath said circuit board and having third and fourth electrically conductive power pins extending through said circuit board and spaced apart from said first and second power pins;

first and second conductor traces formed on said circuit board and respectively connected at one end to said first and second power pins and at and an opposite end to said third and fourth power pins; and a third electrical connector configured to mate with said second electrical connector and to supply said unconditioned A.C. power to said input circuit board.

19. The LED light fixture of claim 18 further comprising a second electrical conductor path for conducting the conditioned A.C. line signal from said input circuit board to said A.C. LED Driver circuit.

20. The LED light fixture of claim 19 wherein said second electrical conductor path comprises fifth and sixth electrically conductive power pins on said second electrical connector and wherein said third electrical connector is configured to receive said conditioned A.C. line signal from said input circuit board.

* * * * *